US007905350B2

(12) United States Patent
Wood et al.

(10) Patent No.: US 7,905,350 B2
(45) Date of Patent: Mar. 15, 2011

(54) SIDE-OPEN GUN CASE

(76) Inventors: Michael Tate Wood, Cordova, TN (US); Bobby Lee Windham, Olive Branch, MS (US)

( * ) Notice: Subject to any disclaimer, the term of this patent is extended or adjusted under 35 U.S.C. 154(b) by 1522 days.

(21) Appl. No.: 10/804,458

(22) Filed: Mar. 19, 2004

(65) Prior Publication Data

US 2005/0011786 A1 Jan. 20, 2005

Related U.S. Application Data

(60) Provisional application No. 60/456,092, filed on Mar. 19, 2003.

(51) Int. Cl.
*B65D 85/00* (2006.01)
*B65D 85/24* (2006.01)

(52) U.S. Cl. ..... 206/317; 206/315.11; 224/913

(58) Field of Classification Search ..... 206/317, 206/3, 315.11; 224/911–913, 915, 916, 652–655, 224/620, 191; 150/160, 163; 190/111, 112
See application file for complete search history.

(56) References Cited

U.S. PATENT DOCUMENTS

| | | | | |
|---|---|---|---|---|
| 1,336,092 | A * | 4/1920 | Schenkelberger | 150/163 |
| 2,455,296 | A * | 11/1948 | Current | 206/317 |
| 2,901,018 | A * | 8/1959 | Kolpin | 206/317 |
| 4,257,464 | A * | 3/1981 | Binney | 206/205 |
| 4,433,500 | A * | 2/1984 | Kunevicius | 42/96 |
| 5,009,346 | A * | 4/1991 | Butler | 224/605 |
| 5,277,306 | A * | 1/1994 | Sargent | 206/315.11 |
| 5,431,970 | A * | 7/1995 | Broun et al. | 428/36.5 |
| 5,669,495 | A * | 9/1997 | West | 206/317 |
| 5,678,344 | A * | 10/1997 | Jones et al. | 42/96 |
| 6,009,996 | A * | 1/2000 | Purdy | 206/317 |
| 6,256,922 | B1 * | 7/2001 | Jones et al. | 42/96 |
| 2003/0106819 | A1 * | 6/2003 | Bennett | 206/317 |

* cited by examiner

*Primary Examiner* — J. Gregory Pickett
(74) *Attorney, Agent, or Firm* — Ober / Kaler; Royal W. Craig

(57) ABSTRACT

A gun case having a waterproof outer shell and an oil impregnated inside fabric liner, and conjoined sidelong and end access openings that allow the gun case to be quickly turned inside out and hung for cleaning and/or drying. Secure fold-over VELCRO® closure flaps are provided for both openings to solidly retain the gun within the gun case and to prevent accidental opening and release of the gun. Padding is disposed between the patterned outer shell fabric and inner liner to cushion the gun as it is transported, and to maintain the buoyancy of the gun case so that it floats even with a gun contained therein.

4 Claims, 1 Drawing Sheet

SIDE-OPEN GUN CASE

CROSS REFERENCE TO RELATED APPLICATIONS

The present application derives priority from U.S. Provisional Patent Application 60/456,092 for "GUN CASE"; Filed: Mar. 19, 2003.

BACKGROUND OF THE INVENTION

1. Field of the Invention

The present invention relates to hunting accessories and, more particularly, to a pliable fabric gun case having a side-long access opening that allows easy opening for access to the gun, plus complete inversion for convenient drying.

2. Description of the Background

Gun cases have long been used, by sportsmen, to protect their long guns during transport. Typically, such cases are formed in the general shape of a gun and are made of leather or padded fabric to cushion the gun and to protect it from the elements. Because waterfowl hunters often use their gun cases in salt marshes and back bay areas, the exterior fabric of waterfowl gun cases is most often waterproof (by a waterproof material or coating with a waterproofing substance). The gun, once inserted, is enveloped by a soft absorbent cloth which dries the wood and metal portions of the gun without scratching. Most gun cases are equipped with various fittings in the form of loops, handles and straps for hanging, lifting and carrying the gun case. Given the elongated shape of guns, it is convenient to hang the gun case in upright orientation and to carry it in horizontal orientation so the loops handles and straps are attached at appropriate locations to facilitate hanging and carrying in upright and horizontal orientations respectively.

The need for the case to be supported from its fittings in various orientations demands that the access opening be completely secure to remain closed while the weight of the gun is bearing against it. Otherwise, the gun might suddenly slip from the case and cause damage or a potentially serious injury in the event that the gun should discharge. In this regard, most prior art gun cases have a single access opening located at the distal end of the case where the butt of the gun rests. Other gun cases are opened along lengthwise along the top seam. In either case, the opening might be closed by a zipper or fold-over flap. However, the extent of the opening is minimized (while still allowing withdrawal of the gun) so as to maximize the security and moisture resistance of the gun case. Otherwise, if the gun case encounters moist and/or salty conditions the absorbent fabric on the inside surface of the case becomes moist and the gun itself quickly rusts. Since these prior art gun cases do not fully open and cannot be turned inside out, they cannot be conveniently dried out and this often takes a great deal of time and effort. Indeed, a typical gun case having a single access opening at the butt end is almost impossible to dry because of the elongated shape with relatively small opening. Also, the waterproof or water resistant properties of the exterior of the case work to inhibit drying of the inside surface.

In light of the foregoing there remains a need for a gun case which can be completely opened and inverted for easy access and drying, and yet securely closed to bear the weight of a gun without accidentally release.

SUMMARY OF THE INVENTION

It is, therefore, the primary object of the present invention to provide an improved gun case having one or more access openings with at least one access opening occupying a significant portion of the length of the gun case and opening to expose a significant portion of the inside of the gun case.

It is still another object to provide an improved gun case having a secure closure or closures capable of remaining closed while the weight of the gun bears on them.

It is still another object to provide a gun case having an oil impregnated inner fabric lining to repel moisture and prevent oxidation of the gun stored therein.

It is still another object to provide a gun case that remains buoyant even with a gun stored therein.

In accordance with the above objects, the present invention is an improved gun case having an elongated weather resistant fabric form with one end narrowed to accommodate the muzzle of the gun and another end widened to accommodate the butt of the gun. The gun case is equipped with a loop, handle and a strap, for hanging, lifting and carrying the gun case. A first access opening is provided at the widened end of the gun case, and this is closable by a first fold-over flap that attaches to the outside surface of the gun case by suitable attaching means (such as VELCRO® hook and loop fasteners). A second access opening is provided along the length of the gun case, and this is closable by a second fold-over flap that attaches to the outside surface of the gun case. The second access opening occupies a significant extent along the length of the gun case so that a significant portion of the inside is exposed upon opening of the second flap. The first access opening conjoins the first access opening, and when both flaps are pulled back they allow the gun case to be completely inverted. The gun case can be hung over a line for quick and convenient drying out.

The gun case is preferably formed of a durable, weather/waterproof outside fabric over a padded and buoyant liner, with a fabric liner impregnated with paraffin wax or other petrolatum compound to displace any water and to protect the gun from corrosion. The layered buoyant padding contained within a water-proof outer shell allows the gun case to float even with a gun contained therein.

BRIEF DESCRIPTION OF THE DRAWINGS

Other objects, features, and advantages of the present invention will become more apparent from the following detailed description of the preferred embodiments and certain modifications thereof when taken together with the accompanying drawings in which.

DETAILED DESCRIPTION OF THE PREFERRED EMBODIMENT

Figure 1:
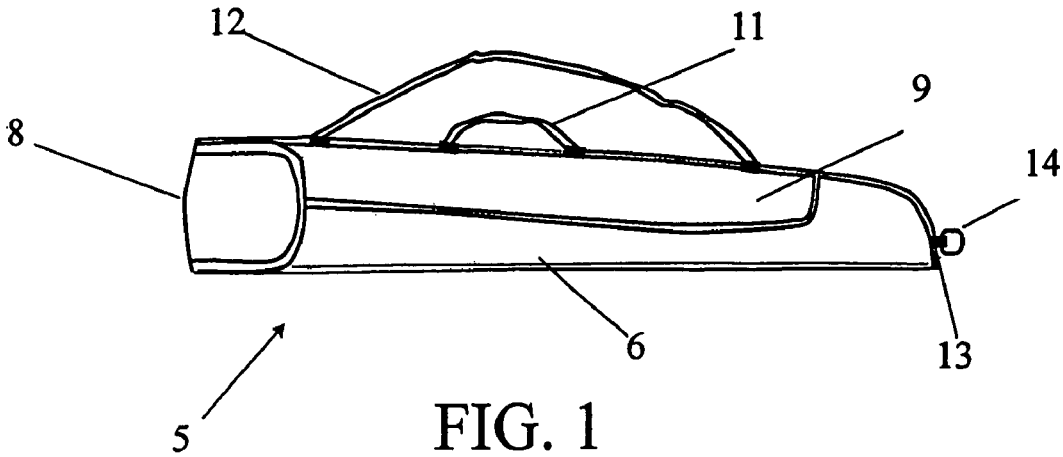
FIG. 1 is a front elevation view of a gun case of the preferred embodiment of the present invention.
Figure 2:
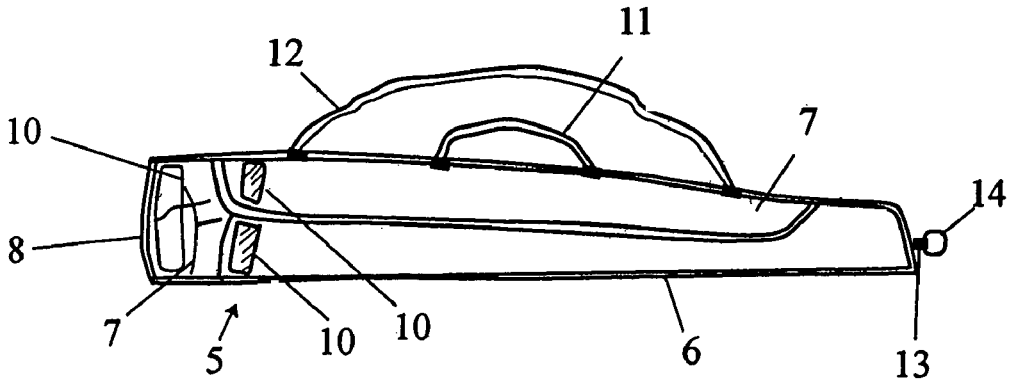
FIG. 2 is a front elevation view of the gun case of the preferred embodiment of the present invention showing the flap at the widened end.
Figure 3:
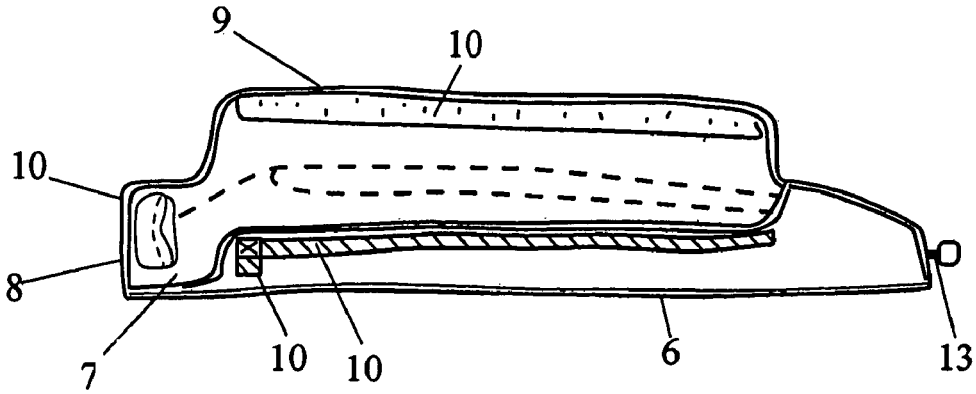
FIG. 3 is a perspective view of the gun case of the preferred embodiment of the present invention, shown with the flap at the widened end and the flap along the length, in the open position.

The preferred embodiment of the gun case 5 of the present invention as shown in FIGS. 1,2 and 3, provides an improved article for protecting and transporting a gun to be used by a sportsman. The gun case 5 generally includes an outside shell fabric 6, shown in FIGS. 1 and 2, integrally sewn to an inside lining fabric 7, the two being uniformly cut and sewn together and reinforced along their periphery with a rolled fabric strip overlying the edges. The gun case 5 is patterned in the general shape of a gun, being elongated with a narrowed end to accommodate a gun muzzle and a widened end to accommodate a gun butt.

The outside fabric 6 is preferably a weather resistant durable material, such as canvas duck or ballistic nylon weave. The outside fabric is either treated with a waterproofing compound, or may itself be a waterproof material. The inside fabric 7 serves as a padded liner for the outside fabric 6, and is preferably a soft absorbent material such as tufted cotton bound by a fabric facing for enveloping the gun. Preferably, additional padding is disposed between the outside fabric 6 and the inside fabric 7 to cushion the gun as it is transported, and also to maintain the buoyancy of the gun case 5, such that the gun case 5 will float even with the weight of a gun contained therein. For this purpose, polyurethane foam or other suitable padding may be used. In the preferred embodiment, the inside fabric 7 is preferably a canvas or other rugged fabric liner impregnated with paraffin to displace moisture and prevent it from building up in the cloth. The use of a fabric liner impregnated with paraffin wax, oil or other suitable petrolatum compound to displace water protects the gun from corrosion.

The gun case 5 is provided with a first fold-over flap 8, located at the widened end and having a proximal edge integrally formed with the back of the gun case 5 and a distal edge movable between an open position for allowing access to the enclosure, as shown in FIG. 1, and a closed position such that the first flap 8 extends to the front of the gun case 5 and contacts the outer aspect of the outside fabric 6, thereby preventing access to the enclosure, as shown in FIG. 2. The said first flap 5 is releasably secured in closed position by VELCRO® hook and loop fastener strips 10 affixed to the distal edge of the first flap 8 and to the outer aspect of the outside fabric 6. The gun case 5 is provided with a second flap 9 located along, and occupying a significant portion of, the length of the gun case 5. The said second flap 9 having a proximal edge integrally formed with the back of the gun case 5 and a distal edge being movable between an open position allowing access to the enclosure, as shown in FIG. 3, and a closed position such that the second flap 9 extends to the front of the gun case 5 and contacts the outer aspect of the outside fabric 6, thereby preventing access to the enclosure, as shown in FIGS. 1 and 2. The said second flap 9 is releasably secured in closed position by VELCRO® hook and loop fastener strips 10 affixed to the distal edge of the second flap and to the outer aspect of the outside fabric 6. The second flap is of sufficient length to expose a significant portion of the inside fabric, when in the open position. The first flap 8 opening conjoins the second flap 9 opening, and when both flaps are pulled back they allow the gun case to be completely inverted. This way, the gun case 5 can be hung over a line for quick and convenient drying out.

The gun case 5 is provided with a handle 11 and a strap 12, preferably formed of suitable material, such as nylon webbing and attached by suitable means, such as sewing, at two or more points of attachment sufficiently spaced apart and positioned between the ends of the gun case 5 to allow the hand or forearm, respectively, of the sportsman to lift the gun case 5 thereby.

The gun case 5 is provided with a loop 13, preferable formed of suitable material such as nylon webbing and attached by suitable means, such as sewing, to the narrowed end of the gun case 5 and encircling a "D" ring 14 so as to confine the "D" ring 14 within said loop 13 for hanging the gun case 5 in an upright position.

The gun case 5 of the present invention may be opened by manually releasing the first flap 8, the second flap 9 or both to insert or remove a gun by passing the gun lengthwise through the opening exposed by the first flap 8 or by passing the gun outward through the opening exposed by the second flap 9. If a sportsman has placed the gun case 5 in the trunk of a sedan type vehicle, it is particularly convenient to open the second flap 9 and pass the gun outward without having to first lift the gun case 5 out of the trunk, in order to remove or insert the gun. The novel second flap 9 opens to expose a significant portion of the inside fabric 7 to facilitate cleaning and drying of the enclosure, which contacts the gun and can deposit damaging moisture and abrasive material on the gun if not thoroughly clean and dry. Additionally, the inside fabric 7 is impregnated with oil so that a small quantity of oil will be applied to a gun during the process of inserting and removing it from the gun case 5.

In the preferred embodiment, the VELCRO® hook and loop fastener strips 10 are disposed along the entire distal edge of the first flap 8 and second flap 9 with complementary VELCRO® hook and loop fastener strips 10 of equal size and dimensions on the outside fabric 6, as shown in FIG. 3. The strips 10 disposed in this manner provide a secure closure for the access openings of the gun case 5 and prevent accidental opening and release of a gun, even when the weight of a gun is bearing upon the closure.

Having described the present invention, in detail it will be appreciated that variations in the materials and construction may be incorporated without departing from the inventive concept presented herein.

We claim:

1. A gun case for storage of a long gun, comprising:

a fabric enclosure formed by a fabric outer shell sewn to a padded inner liner and reinforced around a peripheral seam, said shell and padded inner liner being folded lengthwise and sewn together at one end to form an elongate enclosure permanently closed along one side and said end, and open along a majority of another side and end and defining conjoined sidelong and end access openings, a first foldover flap movable between an open position and a closed position releasably secured over said end access opening to prevent access to the fabric enclosure, and a second continuous foldover flap movable between an open position and a closed position releasably secured over said sidelong access opening to prevent access to the fabric enclosure, said first and second foldover flaps being movable to the closed position to completely close access to the fabric enclosure and a long gun inserted therein, said first foldover flap being movable to said open position to permit withdrawal of said long gun, and both of said first and second flaps being movable to their respective open positions to fully expose said conjoined sidelong and end access openings they allow the gun case to be quickly turned inside out for cleaning and/or drying.

2. The gun case of claim 1, wherein said conjoined sidelong and end access openings are selectively closable with foldover flaps attached by hook and loop fasteners.

3. The gun case of claim 1, wherein said padded inner liner includes a woven facing that is impregnated with a rust preventative to inhibit corrosion of a gun stored therein.

4. The gun case of claim 1, further comprising padding disposed between the fabric outer shell and padded inner liner to cushion the gun as it is transported, and to maintain the buoyancy of the gun case so that it floats even with a gun contained therein.

* * * * *